United States Patent [19]

Inoue et al.

[11] Patent Number: 4,735,183

[45] Date of Patent: Apr. 5, 1988

[54] APPARATUS FOR CONTROLLING ANGULAR DISPLACEMENT OF A THROTTLE VALVE FOR AN AUTOMOTIVE VEHICLE

[75] Inventors: Hideaki Inoue, Kanagawa; Shinji Katayose, Tokyo; Akira Takei; Minoru Tamura, both of Kanagawa, all of Japan

[73] Assignee: Nissan Motor Company, Limited, Kanagawa, Japan

[21] Appl. No.: 839,193

[22] Filed: Mar. 13, 1986

[30] Foreign Application Priority Data

Apr. 1, 1985 [JP] Japan ..... 60-68763

[51] Int. Cl.[4] ..... F02D 41/00

[52] U.S. Cl. ..... 123/399; 123/403

[58] Field of Search ..... 123/339, 399, 361, 396, 123/403

[56] References Cited

U.S. PATENT DOCUMENTS

| | | | |
|---|---|---|---|
| 4,112,885 | 9/1978 | Iwata et al. | 123/361 |
| 4,519,361 | 5/1985 | Murakami | 123/399 |
| 4,541,378 | 9/1985 | Kitamura | 123/339 |

FOREIGN PATENT DOCUMENTS

| | | |
|---|---|---|
| 58-25853 | 5/1983 | Japan . |
| 59-58131 | 4/1984 | Japan . |

*Primary Examiner*—Andrew M. Dolinar

*Attorney, Agent, or Firm*—Schwartz, Jeffery, Schwaab, Mack, Blumenthal & Evans

[57] ABSTRACT

An apparatus for controlling the angular displacement of a throttle valve for an automotive vehicle includes a return spring attached to the rotational axis of the throttle valve which biases the rotational axis of the throttle valve towards its fully closed position, and which automatically moves the throttle valve to its fully closed position without excessive wear on the throttle valve or on a throttle chamber.

6 Claims, 3 Drawing Sheets

APPARATUS FOR CONTROLLING ANGULAR DISPLACEMENT OF A THROTTLE VALVE FOR AN AUTOMOTIVE VEHICLE

BACKGROUND OF THE INVENTION

1. Field of the Invention

The present invention relates to an apparatus for controlling the angular displacement of a throttle valve in response to the operation of an accelerator, in which a throttle valve is opened or closed by means of a motor in response to operation of the accelerator.

2. Description of the Prior Art

Conventional throttle valve angular displacement control systems are exemplified in a Japanese Patent Examined Open No. Sho. 58-25853 and Japanese Patent Unexamined OPen No. Sho. 59-58131.

Both Japanese Patent documents disclose an actuator comprising a reversible step motor which is connected to a throttle valve located within an intake air passage (throttle chamber) of an engine mounted on a vehicle and which actuates the throttle valve to open or close according to an electrical pulse signal sent to the actuator.

However, in cases where the opening angle of the throttle valve is estimated from a number of step pulses sent to the step motor in the conventional apparata described above, the positional accuracy of the throttle valve is determined by the resolution of the pulses. Therefore, fine adjustment of the opening angle of the throttle valve is difficult even given a higher accuracy than the current accuracy. In addition, since the opening angle of the throttle valve is detected by means of an electrical potentiometer and the detected opening angle is used as a feedback value, additional errors result in the control of the opening angle of the throttle valve due to deviations of the mounting of the potentiometer or fluctuations in a power supply voltage of the potentiometer.

Consequently, it may occur that the accelerator is ordered to a position corresponding to a fully closed state of the throttle valve, but the conventional control apparata cannot accurately hold the throttle valve at the fully closed position so that the engine idling speed may unnecessarily increase and/or the throttle valve may repeatedly abut the walls of the intake air passage at high speed, causing undue wear.

SUMMARY OF THE INVENTION

With the above-described problem in mind, it is an object of the present invention to provide an apparatus for controlling the angular displacement of a throttle valve for an automotive vehicle by which the throttle valve can accurately and smoothly be positioned at its fully closed position when the accelerator is moved to the position corresponding to the fully closed position of the throttle valve.

This can be achieved by providing an apparatus for controlling the angular displacement of a throttle valve for an automotive vehicle, comprising: (a) first means for regulating engine speed according to its position, the engine being forced to idle when the first means is in a first position, (b) second means manually actuable to order the first means to a desired position, (c) third means for detecting a position of the second means and producing a signal according to the position of the second means, (d) fourth means responsive to the signal from the second means for actuating the first means according to the position of the second means, the third means ceasing to drive the first means when the second means is released from manual actuation and no signal is received from the third means, and (e) fifth means for gradually driving the first means to the first position when the second means is released.

BRIEF DESCRIPTION OF THE DRAWINGS

A more complete understanding of the present invention may be obtained from the following description taken in conjunction with the attached drawings in which like reference numerals designate corresponding elements and in which.

DETAILED DESCRIPTION OF THE PREFERRED EMBODIMENT

Reference will hereinafter be made to the drawings in order to facilitate understanding of the present invention.

Figure 1:
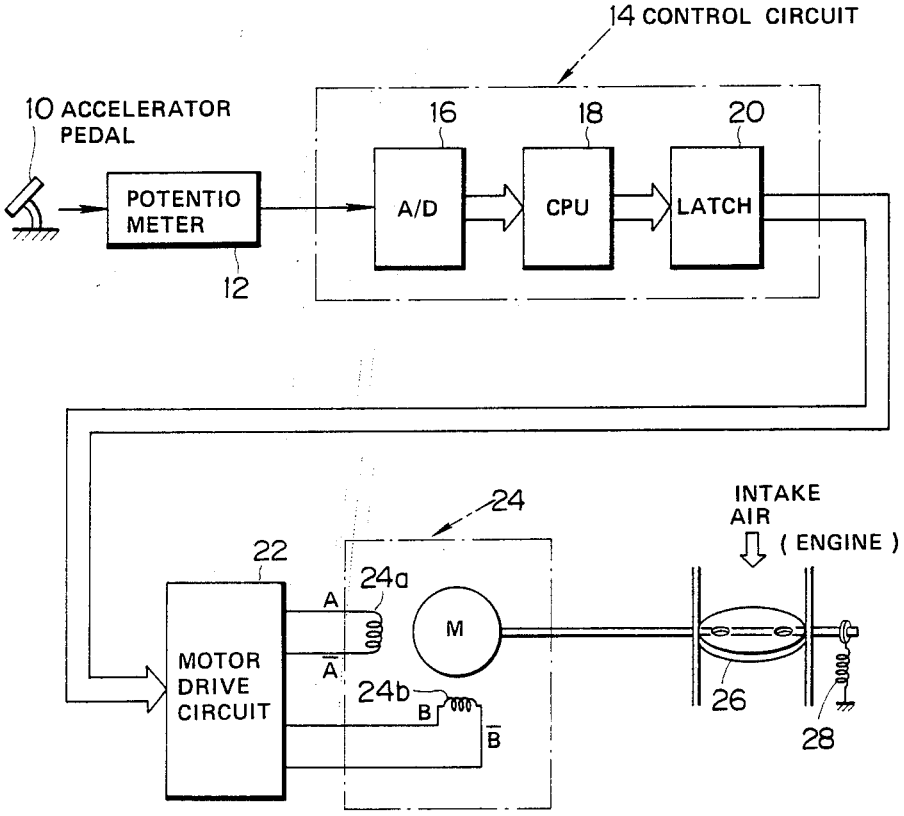
FIG. 1 is a circuit block diagram of an apparatus in a preferred embodiment according to the present invention.

FIG. 1 shows a preferred embodiment of the apparatus for controlling the angular displacement of a throttle valve according to the present invention.

In FIG. 1, an accelerator pedal (accelerator) 10 is, for example, located below a driver's seat of an automotive vehicle (not shown). The depression angle (depression amount) of the accelerator pedal 10 is detected by means of a potentiometer 12. The value detected by the potentiometer 12 is inputted to a throttle valve control circuit 14 as a voltage signal. The throttle valve control circuit 14 comprises a microcomputer and receives the above-described signal from the potentiometer 12 via an analog-to-digital (A/D) converter 16.

The analog signal from the potentiometer 12 is converted into a digital signal by means of the A/D converter 16 and sent to a Central Processing Unit (CPU) 18, which then produces a four-bit control signal for controlling the angular displacement of the throttle valve in accordance with the detected accelerator depression. A latch 20 holds the latest value of the control signal.

The control signal is sent by the latch 20 is sent to a motor drive circuit 22 so that windings **24*a*, 24*b* of a stepping motor 24 are respectively energized and controlled by means of the motor drive circuit 22** in accordance with the control signal described above.

The rotational axis of the throttle valve 26 is driven to rotate by the stepping motor 24, so that the angular displacement of the throttle valve 26 is controlled according to the direction and number of rotations of the motor 24.

It should be noted that a return spring 28 is provided so as to bias the throttle valve 26 towards its fully closed position.

It should also be noted that the angular position of the throttle valve 26 is estimated by the CPU 18 from the number of rotations of the step motor 24 in each direction.

The action of the preferred embodiment will be described with reference to FIGS. 2 and 3.

Figure 2:
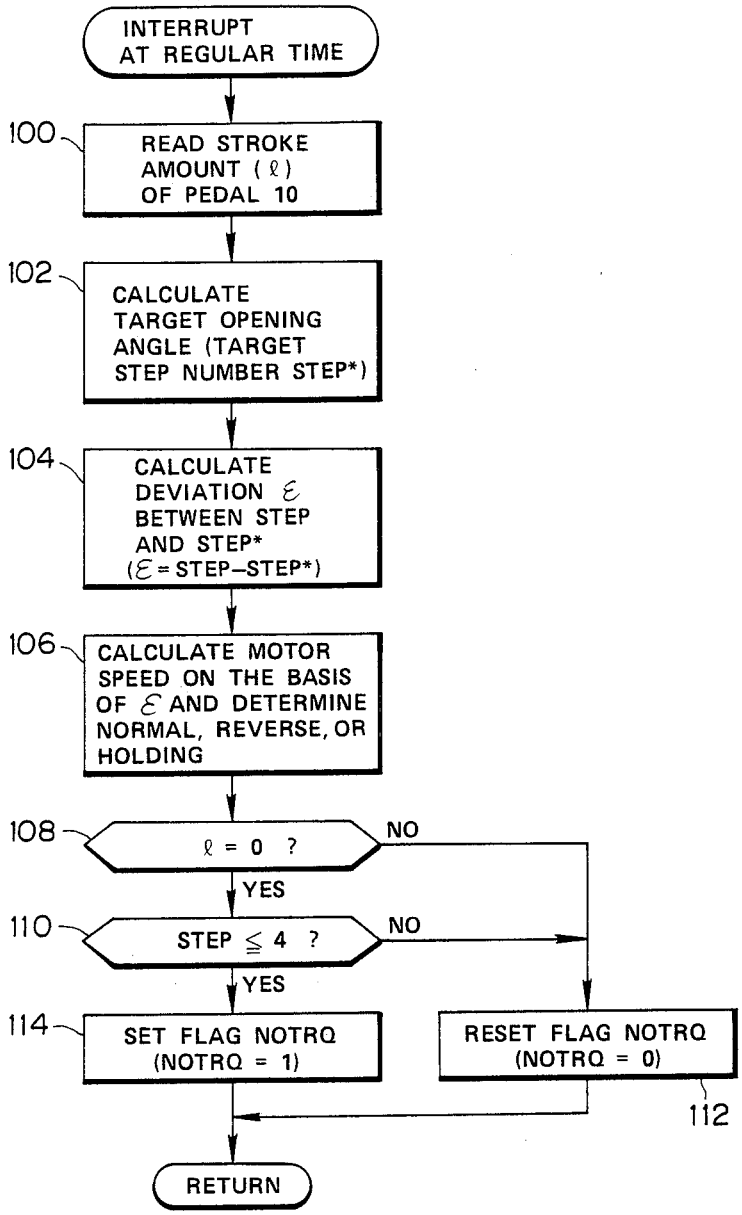
FIGS. 2 and 3 are operational flowcharts for explaining throttle valve control procedures.
Figure 3:
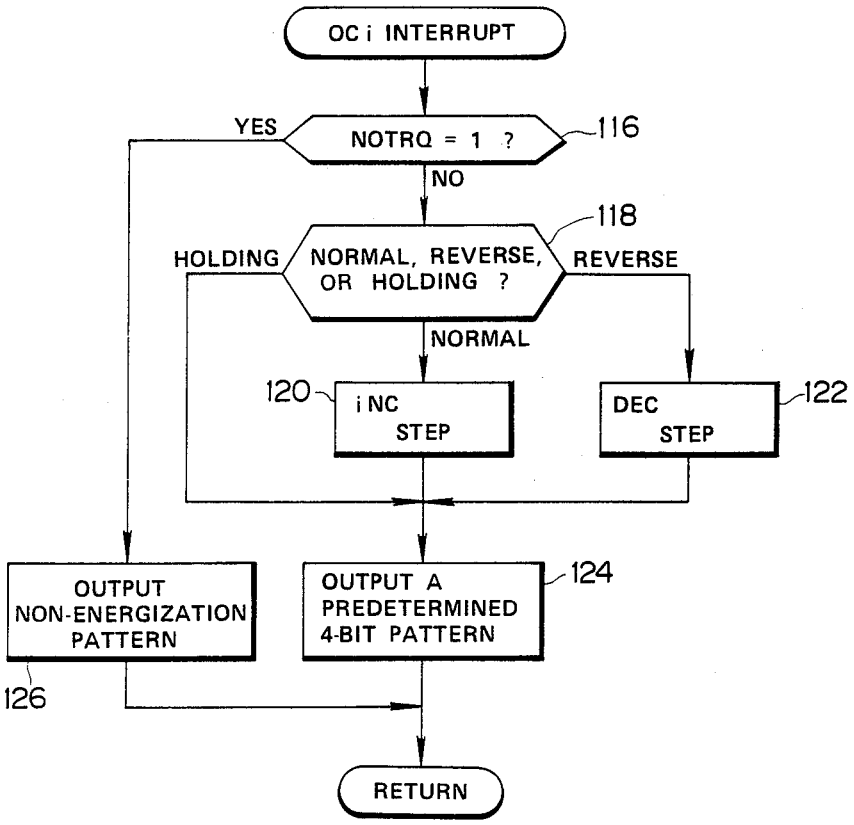

FIG. 2 is a processing flowchart of an interrupt routine executed at predetermined intervals of time by an operating system (OS) (not shown) controlling the CPU 18. The operating system is usually stored in a ROM (Read-Only Memory). FIG. 3 is a processing flowchart of a so-called OCi (Overflow Counter interrupter) interrupt routine reiterated in accordance with the speed of the stepping motor determined by the periodic interrupt routine shown in FIG. 2. That is to say, the CPU of the microcomputer has a counter which counts a number of units of angular movements of the motor 24.

In FIG. 2, the CPU 18 reads the depression angular displacement (stroke λ) of the accelerator pedal 10 in a step 100. In a step 102, the CPU 18 calculates a target opening angle (a target number of steps: STEP*) of the throttle valve 26 in accordance with the accelerator position.

In a step 104, the CPU 18 calculates the deviation ε of the actual step number STEP of the throttle valve 26 from the target step number STEP*.

Furthermore, in a step 106, the CPU 18 calculates the desired motor speed, selects either normal or reverse rotation of the stepping motor 24, and sets the reiteration period of the OCi interrupt routine and a flag indicating the motor rotational direction.

In a step 108, the CPU 18 determines whether the accelerator pedal 10 has been fully released, i.e. if the accelerator pedal 10 has reached a position corresponding to the fully closed position of the throttle valve 26. If so, then in a step 110, the CPU 18 determines whether the throttle valve 26 has reached a position immediately before its fully closed position by determining whether the actual step number STEP of the step motor 24 is four or less.

A non-energization flag NOTRQ is reset in a step 112 if the accelerator pedal 10 has not been released or if the throttle valve 26 has not reached a position immediately before the fully closed position. On the other hand, if the accelerator pedal 10 has been released and the throttle valve 26 has reached a position immediately before the fully closed position, the CPU 18 sets the non-energization flag NOTRQ in a step 114.

The flowchart of the OCi interrupt routine will be described with reference to FIG. 3.

In a step 116, the CPU 18 determines whether the non-energization flag NOTRQ is set. If the flag NOTRQ is not set, the routine goes to a step 118 in which the CPU 18 determines whether the step motor 24 is at rest, rotating in the normal direction, or rotating in the reverse direction.

Given normal rotation, one is added to the actual number of steps STEP in a step 120. One is subtracted from the actual number of steps STEP if the CPU 18 determines that the motor is rotating in reverse. The actual activation step number STEP remains unchanged if the CPU 18 determines that the motor is at rest.

The actual step number STEP obtained in the steps 120, and 122 corresponds to the actual opening angle of the throttle valve 26 and is used in the calculation of the above-described deviation ε.

In a step 124, one of the energization patterns 1, 2, 3, and 4 shown in Table 1 is selected in a predetermined order which determines the rotational direction of the step motor 24.

TABLE 1

| Energization Pattern | 27 | 26 | 25 | 24 | 23 | 22 | 21 | 20 |
|---|---|---|---|---|---|---|---|---|
| 1 | x | x | x | x | 1 | 0 | 0 | 0 |
| 2 | x | x | x | x | 0 | 0 | 1 | 0 |
| 3 | x | x | x | x | 0 | 1 | 0 | 0 |
| 4 | x | x | x | x | 0 | 0 | 0 | 1 |
| Non-Energization Pattern | x | x | x | x | 1 | 1 | 1 | 1 |

The energization patterns 1, 2, 3, and 4 of Table 1 specify which of the motor terminals A and B received current and in which polarity (i.e. from A to $\overline{A}$ or vice versa).

Specifically, when the energization pattern is changed from the pattern 1 to the pattern 2, the stepping motor 24 is activated in the normal rotational direction. As the energization pattern is changed in the sequence 3, 4, 1, 2, and 3, the stepping motor 24 is activated repeatedly in the normal rotation direction. On the other hand, when the energization patterns are selected in the order 1, 4, 3, 2, 1, and 4, the step motor 24 is sequentially and intermittently activated in the reverse direction.

In this way, the energization patterns 1, 2, 3, and 4, are selected in a predetermined order so that the stepping motor 24 is rotated stepwise either normally and in reverse. The throttle valve 26 is opened or closed, for example, by 1.8 degrees per motor step.

When the accelerator pedal 10 is released, the throttle valve 26 is at the position immediately before the fully closed state, and the flag NOTRQ is set when checked in the step 116, the non-energization pattern shown in Table 1 is selected in a step 126. Thus, none of the windings *24a*, *24b* of the stepping motor 24 are energized that actuation for the throttle valve 26 to the fully closed position is carried out solely by means of the return spring 28. Hence, in spite of release of the accelerator pedal 10, the throttle valve 26 can attain the fully closed position without clearance with respect to the throttle chamber. In addition, since the throttle valve 26 comes briefly to rest at the position immediately before the fully closed position, the throttle valve 26 will not impinge upon the throttle chamber at a high speed.

It should be noted that when the actual step number STEP of the stepping motor 24 is a given small number, e.g. four or less, the CPU 18 recognizes that the throttle valve 26 is at the position immediately before the fully closed position. This is because the rotational position of the stepping motor 24 does not always accord with the fully closed position of the throttle valve 26. In the method in which four patterns 1, 2, 3, and 4 are selected sequentially as in the preferred embodiment, the maximum error is three steps and thus an allowance of four or less steps should suffice.

Since in the preferred embodiment, the throttle-valve-drive stepping motor 24 is deenergized when the throttle valve 26 has reached a position immediately before the fully closed position and thereafter the biasing force of the return spring 28 drives the throttle valve 26 to the fully closed position, the throttle valve 26 can accurately attain the fully closed position while avoiding high-speed collision with the throttle chamber as it reaches the fully closed state.

Therefore, the durability of the throttle unit is improved and the idling speed of the engine can be held reliably at the normal engine idling speed.

Furthermore, although the opening angle of the throttle valve and the energization pattern must be adjusted when the step motors and throttle valves are installed within mass-produced vehicles in such a way that a throttle opening angle of zero coincides with pattern 1, fine adjustment of the throttle valve in the fully closed position is carried out by means of the return spring 28 so that the time and labor required for fine adjustment is reduced and thereby manufacturing costs are accordingly reduced.

It should be noted that the same effect can be achieved by an apparatus in which the opening angle of the throttle valve is detected by means of a potentiometer.

It will clearly be appreciated by those skilled in the art that the foregoing description is made in terms of the preferred embodiment and various changes and modifications may be made without departing from the scope of the present invention which is defined by the appended claims.

What is claimed is:

1. An apparatus comprising:

(a) a throttle valve for regulating engine speed according to its position, the engine being forced to idle when said throttle valve is in a fully closed position;

(b) second means manually actuable to order said throttle valve to a desired position;

(c) third means for detecting a position of said second means and producing an electrical signal according to the position of said second means;

(d) fourth means responsive to the signal from said third means for driving said throttle valve with a first force according to the position of said second means, said fourth means ceasing to drive said throttle valve when said second means is released from manual actuation and said throttle valve reaches a predetermined position immediately before said fully closed position; and (e) fifth means for gradually driving said throttle valve from said predetermined position to said fully closed position with a second force thereby preventing said throttle valve from impinging upon a wall of the throttle chamber of the engine after the fourth means ceases to drive the throttle valve.

2. An apparatus comprising:

(a) first means for regulating engine speed according to its position, the engine being forced to idle when said first means is in a first position;

(b) second means manually actuable to order said first means to a desired position;

(c) third means for detecting a position of said second means and producing a signal according to the position of said second means;

(d) fourth means responsive to the signal from said second means for actuating said first means according to the position of said second means, said fourth means ceasing to drive said first means when said second means is released from manual actuation and no signal is received from said third means; and (e) fifth means for gradually driving said first means to said first position when said second means is released;

wherein said first means is a throttle valve located within a throttle chamber and a rotational axis of said throttle valve is linked with said fourth means and wherein said fifth means is a return spring attached to the rotational axis of said throttle valve so as to bias the throttle valve toward the first position;

said second means is an accelerator pedal and wherein said fourth means drives the throttle valve to a second position near said first position when said accelerator pedal is released; and sixth means for detecting whether the throttle valve has reached the second position and outputting a signal indicative thereof to said fourth means.

3. The apparatus according to claim 2, wherein the first position of the throttle valve is its fully closed position.

4. An apparatus comprising:

(a) first means for regulating engine speed according to its position, the engine being forced to idle when said first means is in a first position;

(b) second means manually actuable to order said first means to a desired position;

(c) third means for detecting a position of said second means and producing a signal according to the position of said second means;

(d) fourth means responsive to the signal from said second means for actuating said first means according to the position of said second means, said fourth means ceasing to drive said first means when said second means is released from manual actuation and no signal is received from said third means; and (e) fifth means for gradually driving said first means to said first position when said second means is released;

wherein said first means is a throttle valve located within a throttle chamber and a rotational axis of said throttle valve is linked with said third means and wherein said fifth means is a return spring attached to the rotational axis of said throttle valve so as to bias the throttle valve toward the first position;

said second means is an accelerator pedal and wherein said fourth means drives the throttle valve to a second position near said first position when said accelerator pedal is released; and said fourth means comprises a reversible stepping motor and detects whether the throttle valve has reached the second position from a rotational direction and number of turns of the stepping motor.

5. An apparatus, comprising:

(a) a throttle valve located within a throttle chamber of an internal combustion engine;

(b) an accelerator pedal manually actuable to order the throttle valve to a desired angular position;

(c) first means for detecting a position of the accelerator pedal and producing a signal according to the position of the accelerator pedal;

(d) second means responsive to the signal from said first means for actuating said throttle valve according to the position of the accelerator pedal, the second means ceasing to drive the throttle valve when the accelerator pedal is released from manual actuation and no signal is received from the first means, said second means driving the throttle valve until the throttle valve is directed toward a position immediately before a fully closed position of the throttle valve when the accelerator pedal is released, the position of the throttle valve being detected by an actuation amount of the second means itself; and (e) third means for gradually driving the throttle valve to the fully closed position when the accelerator pedal is released, the third means being a return spring attached to the rotational axis of the throttle valve so as to bias the throttle valve to the fully closed position.

6. The apparatus according to claim 5, wherein the second means includes a reversible stepping motor and the first means detects whether the throttle valve has reached the position immediately before the fully closed position from a rotational direction and number of turns of the stepping motor.

* * * * *